United States Patent [19]

Daroca

[11] Patent Number: 5,007,587

[45] Date of Patent: Apr. 16, 1991

[54] COMBINED FENCE AND IRRIGATION SYSTEM

[76] Inventor: Allen P. Daroca, 103 Lakeland Dr., Slidell, La. 70458

[21] Appl. No.: 448,979

[22] Filed: Dec. 12, 1989

[51] Int. Cl.[5] ..... B05B 9/00

[52] U.S. Cl. ..... 239/289; 239/276; 256/1

[58] Field of Search ..... 239/289, 279, 276, 273, 239/211, 200; D25/40; 256/1

[56] References Cited

U.S. PATENT DOCUMENTS

| | | | |
|---|---|---|---|
| D. 86,991 | 5/1932 | Beauchamp . | |
| D. 171,325 | 1/1954 | Yellin . | |
| D. 276,494 | 11/1984 | Novak et al. . | |
| 2,670,182 | 2/1954 | Oberwerger . | |
| 2,799,480 | 7/1957 | Mead . | |
| 3,865,309 | 2/1975 | Greenhalgh | 239/289 |
| 3,933,311 | 1/1976 | Lemelson | 239/276 |

FOREIGN PATENT DOCUMENTS

| | | | |
|---|---|---|---|
| 1568640 | 5/1969 | France | 239/276 |

*Primary Examiner*—David M. Mitchell

*Assistant Examiner*—Lesley D. Morris

*Attorney, Agent, or Firm*—Jerry T. Kearns

[57] ABSTRACT

A combined fence and irrigation system is formed by a plurality of generally vertical spaced posts and a plurality of generally horizontal connecting rails. A countersunk circular aperture is formed through each face of the rectangular posts at a predetermined vertical level. Each of the posts terminates in a ground insertion spike and is of a tubular construction to allow fluid passage. An end face of each of the rails is provided with a central countersunk circular aperture. The countersunk apertures of the rails and the posts each have an inserted resilient bushing. A connecting tube has opposite ends provided with stepped frusto conical ridges for engagement within the resilient bushings to provide a mechanical and fluid connection between the posts and rails. A plurality of spray nozzles include similar frusto conical ridges and may be disposed at selected locations on the posts for irrigating a surrounding area. A screen may be installed on the fence by alignment with a plurality of grommets with selected countersunk apertures of the posts. Ornamental mounting studs may be utilized to secure the screen to the posts.

15 Claims, 3 Drawing Sheets

COMBINED FENCE AND IRRIGATION SYSTEM

BACKGROUND OF THE INVENTION

1. Field of the Invention

The present invention relates to fence systems, and more particularly pertains to a combined fence and irrigation system which provides an ornamental enclosure and an effective irrigation system for a garden or other enclosed area.

2. Description of the Prior Art

Various types of fence systems are known in the prior art. A typical example of such a fence system is to be found in Design U.S. Pat. No. 86,991, which issued to G. Beauchamp on May 24, 1932. This patent discloses a portable ornamental fence formed by a plurality of vertical posts and horizontal rails. Design U.S. Pat. No. 171,325, which issued to B. Yellin on Jan. 24, 1954, discloses an ornamental fence having a plurality of carved ornamental figures thereon and supported by a plurality of spaced vertical posts having pointed ground insertion ends. U.S. Pat. No. 2,670,182, which issued to W. Oberwerger on Feb. 23, 1954, discloses an ornamental fence formed by a plurality of vertical posts configured to resemble flowers. U.S. Pat. No. 2,799,480, which issued to R. Mead on Jul. 16, 1957, discloses an ornamental fence formed from a molded plastic material which resembles a row of flowers. Design U.S. Pat. No. 276,494, which issued to P. Novak et al on Nov. 27, 1984, discloses a plastic landscape edging unit configured to resemble a plurality of spaced tree stumps.

While the above mentioned devices are directed to various fence systems, none of these devices disclose a combination fence and irrigation system formed in a modular construction to allow convenient assembly and a wide variety of selected configurations. Inasmuch as the art is relatively crowded with respect to these various types of fence systems, it can be appreciated that there is a continuing need for and interest in improvements to such fence systems, and in this respect, the present invention addresses this need and interest.

SUMMARY OF THE INVENTION

In view of the foregoing disadvantages inherent in the known types of fence systems now present in the prior art, the present invention provides an improved combined fence and irrigation system. As such, the general purpose of the present invention, which will be described subsequently in greater detail, is to provide a new and improved combined fence and irrigation system which has all the advantages of the prior art fence systems and none of the disadvantages.

To attain this, a representative embodiment of the concepts of the present invention is illustrated in the drawings and makes use of a combined fence and irrigation system which is formed by a plurality of generally vertical spaced posts and a plurality of generally horizontal connecting rails. A countersunk circular aperture is formed through each face of the rectangular posts at a predetermined vertical level. Each of the posts terminates in a ground insertion spike and is of a tubular construction to allow fluid passage. An end face of each of the rails is provided with a central countersunk circular aperture. The countersunk apertures of the rails and the posts each have an inserted resilient bushing. A connecting tube has opposite ends provided with stepped frusto conical ridges for engagement within the resilient bushings to provide a mechanical and fluid connection between the posts and rails. A plurality of spray nozzles include similar frusto conical ridges and may be disposed at selected locations on the posts for irrigating a surrounding area. A screen may be installed on the fence by alignment with a plurality of grommets with selected countersunk apertures of the posts. Ornamental mounting studs may be utilized to secure the screen to the posts.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved combined fence and irrigation system which has all the advantages of the prior art fence systems and none of the disadvantages.

It is another object of the present invention to provide a new and improved combined fence and irrigation system which may be easily and efficiently manufactured and marketed.

It is a further object of the present invention to provide a new and improved combined fence and irrigation system which is of a durable and reliable construction.

An even further object of the present invention is to provide a new and improved combined fence and irrigation system which is susceptible of a low cost of manufacture with regard to both materials and labor, and which accordingly is then susceptible of low prices of sale to the consuming public, thereby making such fence systems economically available to the buying public.

Still yet another object of the present invention is to provide a new and improved combined fence and irrigation system which provides in the apparatuses and methods of the prior art some of the advantages thereof, while simultaneously overcoming some of the disadvantages normally associated therewith.

Still another object of the present invention is to provide a new and improved combined fence and irrigation system for enclosing and irrigating a lawn or garden area.

Yet another object of the present invention is to provide a new and improved combined fence and irrigation system having an attractive ornamental appearance.

Even still another object of the present invention is to provide a new and improved combined fence and irrigation system having a modular construction to allow assembly in a variety of different configurations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
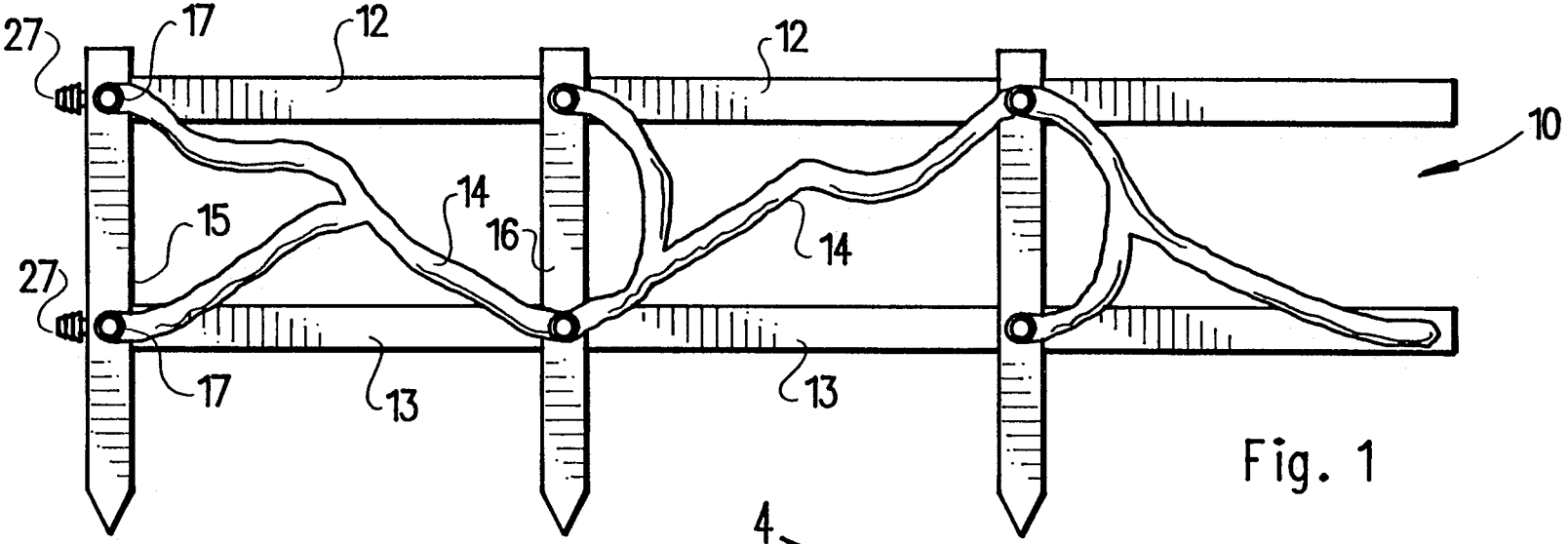
FIG. 1 is a side elevational view of the fence system of the present invention.

With reference now to the drawings, and in particular to FIG. 1 thereof, a new and improved combined fence and irrigation system embodying the principles and concepts of the present invention and generally designated by the reference numeral 10 will be described.

More specifically, it will be noted that the first embodiment 10 of the invention includes a plurality of spaced vertical posts, for example 15 and 16. A plurality of horizontal connecting rails 12 and 13 extend between the posts 15 and 16. The posts 15, 16 and the rails 12, 13 are preferably formed as a rectangular tube having a hollow interior. The posts and rails may be formed from a metal material such as aluminum, or alternatively from a molded plastic material. A plurality of countersunk circular apertures 17 are formed at spaced locations along each of the vertical posts. It should be noted that two of the circular apertures 17 are provided on at least three of the rectangular side faces of each of the posts. A pair of connecting tube members 27 are frictionally engaged in two of the spaced apertures provided on an end wall of the post 15. The connecting tubes 27 are utilized to connect the hollow interior fluid passages formed within the posts 15, 16 and rails 12, 13, with a water supply source. The connecting tubes 27 also form mechanical and fluid connections between the posts and rails. Additionally, a plurality of decorative simulated stem-like cross brace members 14 are utilized to increase the strength of the fencing system. The posts 15, 16 and rails 12 and 13 are preferably colored brown, while the brace members 14 are colored green to provide a realistic simulation of actual vegetation.

Figure 2:
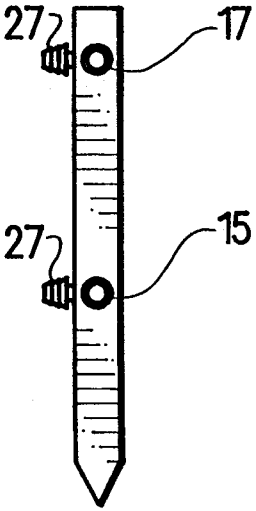
FIG. 2 is a side elevational view illustrating a vertical post of the fence system of the present invention.

FIG. 2 illustrates a side elevational view of the vertical post 15. As shown, the bottom end of the post 15 may be provided with a ground insertion point 21 to facilitate installation of the post in a ground surface.

Figure 3:
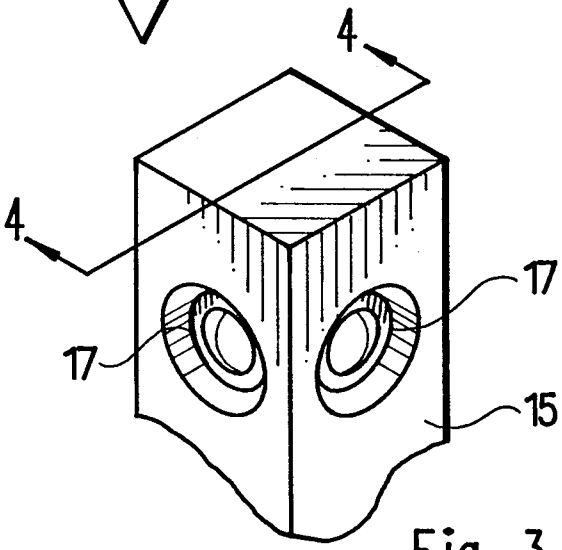
FIG. 3 is a partial perspective view illustrating the top portion of a vertical post.

FIG. 3 is a perspective view illustrating the top portion of the post 15, further illustrating two of the countersunk circular aperture 17 which communicate with the hollow interior of the square or rectangular post 15.

Figure 4:
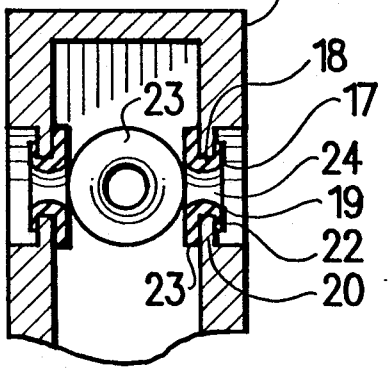
FIG. 4 is a longitudinal cross sectional view, taken along line 4—4 of FIG. 3.

As shown in the cross sectional view of FIG. 4, each of the countersunk circular apertures 17 is provided with an inserted bushing 19, preferably formed from a resilient rubber material. A radial ledge 20 is formed around the circular aperture 17, and the resilient bushing 19 includes a central portion 18 terminating in spaced radially extending flanges 22 and 23. The ledge 20 is in frictional engagement with the central circular portion 18 of the bushing 19, and is captured between the flanges 22 and 23. A central passage 24 is formed through the interior of the bushing 19.

Figure 5:
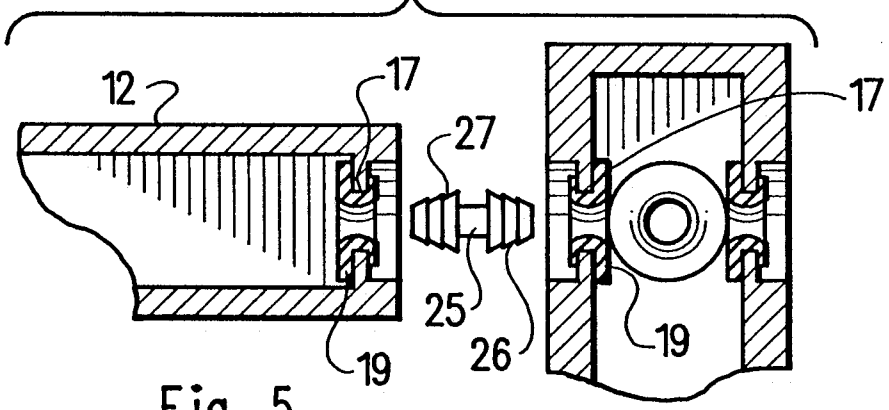
FIG. 5 is an exploded cross sectional view, illustrating the manner of connection of a horizontal rail with a vertical post.

As illustrated in FIG. 5, a similar bushing 19 is installed within a countersunk circular aperture 17 formed in an end face of the horizontal rail 12. The connecting tube includes a central cylindrical tubular portion 25 which terminates at opposite ends in a plurality of oppositely facing axially spaced stepped diameter frusto conical ridges 26 and 27. The ridge portions 26 and 27 are dimensioned for frictional insertion into the bushings 19, thus providing a mechanical and fluid connection between the post 15 and the rail 12.

Figure 6:
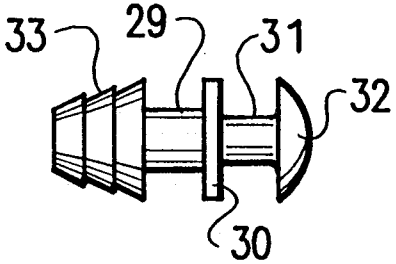
FIG. 6 is a side view illustrating a mounting stud for securing a screen to the fence of the present invention.

FIG. 6 illustrates a mounting stud utilized for a purpose to be described subsequently. The mounting stud includes a connection end portion 33 having a plurality of axially spaced stepped diameter frusto conical ridges. An intermediate cylindrical stem 29 terminates in a radial flange 30. A recess is formed within the cylindrical stem 29 and is dimensioned for insertion of a pin member 31 having an enlarged head 32.

Figure 7:
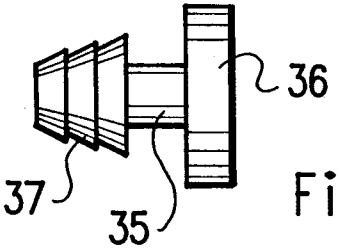
FIG. 7 illustrates a plug member for closing unused circular apertures to maintain a sealed fluid system.

FIG. 7 illustrates a plug member having a frusto conical stepped connection end portion 37, an intermediate cylindrical portion 35 and an enlarged head 36. The plug member of FIG. 7 is utilized to provide a blockage or stop to selected ones of the circular apertures 17, to a fluid seal.

Figure 8:
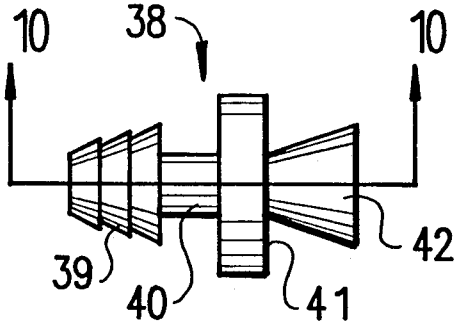
FIG. 8 is a side view illustrating a spray irrigation nozzle.

FIG. 8 illustrates a spray distribution nozzle 38 which includes a connection end portion 39 having a plurality of axially spaced stepped diameter frusto conical ridges, an intermediate cylindrical portion 40, a radial flange 41 and a frusto conical nozzle portion 42. The spray nozzle 38 is installed in selected ones of the undercut circular apertures 17 in either the posts or rails to provide irrigation to an adjacent area.

Figure 9:
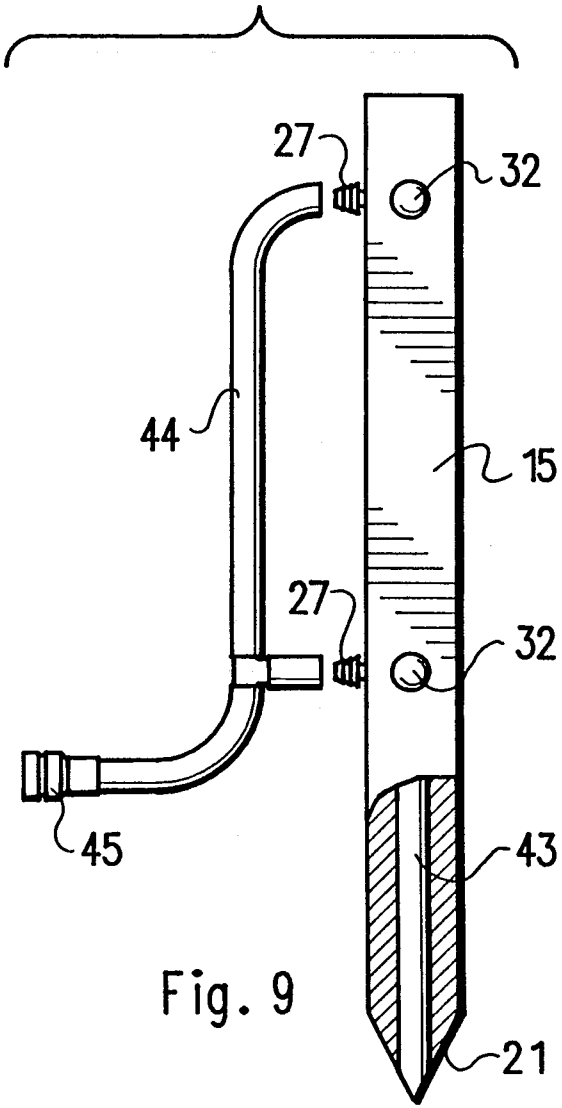
FIG. 9 is an exploded side view illustrating the manner of connecting the fence of the present invention to a water supply line.

FIG. 9 illustrates a manifold tube 44 having a conventional threaded coupling 45 for connection to a conventional water supply line, for example a garden hose. The post 15 may include an axial passage 43 which opens through the pointed ground insertion end 21 to provide a root irrigation.

Figure 10:
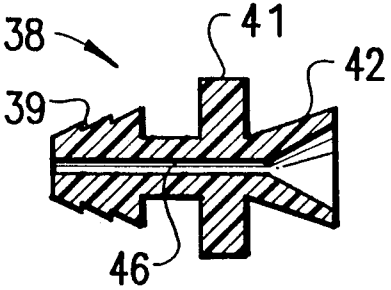
FIG. 10 is a cross sectional view, taken along line 10—10 of FIG. 8.

FIG. 10 is a cross sectional view, taken along line 10—10 of FIG. 8, which illustrates the spray nozzle 38. The nozzle 38 includes a central reduced fluid passage 46, which results in an increased pressure fluid spray, to produce an effective irrigation effect.

Figure 11:
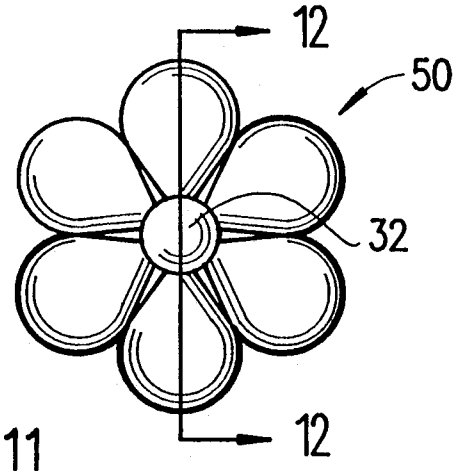
FIG. 11 is a front view illustrating an ornamental cover for use in securing a fence screen.

FIG. 11 illustrates an ornamental flower cover 50, which may be installed in the circular aperture 17 of the vertical post, utilizing the mounting stud illustrated in FIG. 6. The enlarged head 32 of the mounting stud forms a central portion of the ornamental cover 50. The flower 50 may be formed in a variety of colors and shapes to simulate actual flower varieties, for example: yellow daisies, violet violets, red, orange, yellow, and various colors of roses.

Figure 12:
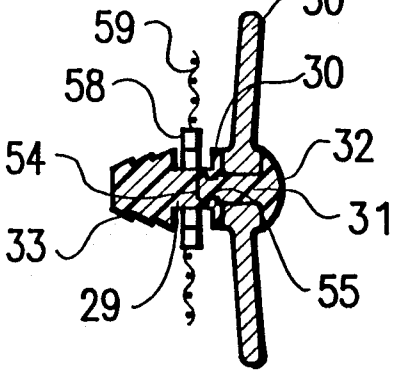
FIG. 12 is a cross sectional view, taken along line 12—12 of FIG. 11, further illustrating the manner of mounting a fence screen.

As shown in the cross sectional view of FIG. 12, the ornamental cover 50 is captured between the enlarged head 32 and the radial flange 30. The pin member 31 is dimensioned for passage through a central circular bore formed through the cover 50 and has a frusto conical end portion 54 connected to the pin member 31 by a reduced diameter stepped portion 55. A complementary formed undercut recess is provided in the intermediate cylindrical portion 29, to allow a snap type frictional engagement of the pin member 31. A fence screen 59 includes a plurality of grommets, one of which is illustrated at 58, which may be received on the cylindrical central portion 29 of the mounting stud. The mounting stud thus allows connection of the fence 59 and the ornamental cover 50, by insertion of the frusto conical ridge portion 33 into a selected one of the undercut circular apertures 17 provided on the vertical posts. The connecting stud, spray nozzle, and ornamental cover may be formed from a resilient plastic material, or from a metal material. Preferably, a plastic construction is utilized to provide the necessary resilience for repeated assembly and disassembly of the fencing system.

Figure 13:
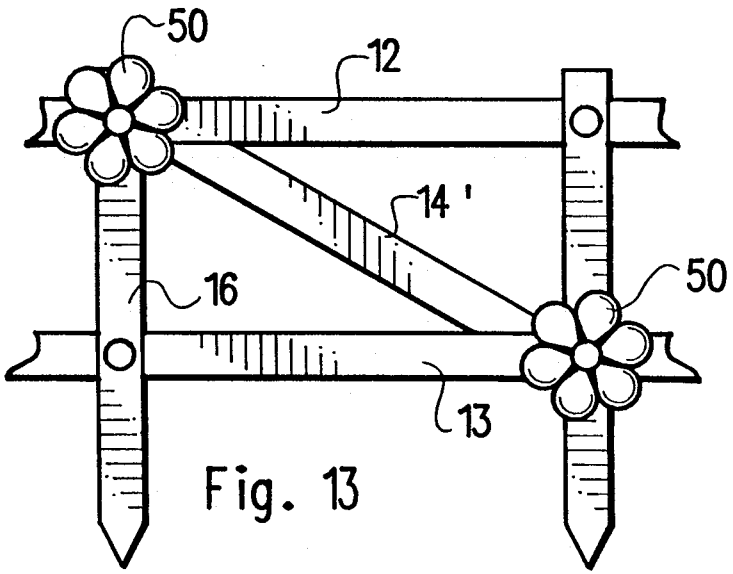
FIG. 13 is a side elevational view illustrating the fence of the present invention, with a pair of ornamental covers installed.

FIG. 13 is a side elevational view, which illustrates two of the ornamental covers 50 installed on the vertical posts. It should be noted that the cross brace members may take an alternative form of diagonal rectangular tubes 14'.

Figure 14:
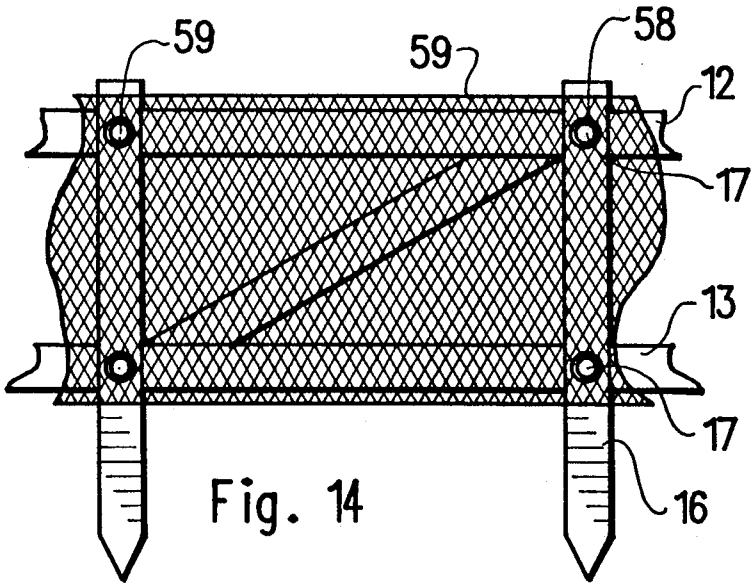
FIG. 14 is a side elevational view illustrating the manner of securing a fence screen to the fencing system of the present invention.

FIG. 14 is a side elevational view, which illustrates the manner of installing a fencing screen 59. The spaced grommets 58 of the screen 59 are disposed for alignment over the undercut circular aperture 17 on the vertical posts 16. The mounting stud and ornamental cover illustrated in FIG. 12 may then be installed in the circular aperture 17, to provide an ornamental securement of the fencing screen 59 to the fence. The screen 59 may be installed in analogous fashion to the fence shown in FIG. 1.

As may now be understood, the present invention provides an ornamental fencing and irrigation system which may be conveniently installed in a variety of different configurations to meet the requirements of various environments.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A combined fence and irrigation system, comprising:

a plurality of generally vertical spaced posts;

a plurality of generally horizontal rails connecting said posts;

fluid passages in said posts and said rails;

each of said posts and said rails provided with countersunk circular apertures communicating with said fluid passages;

a radial ledge formed around each of said circular apertures;

a resilient bushing in each of said circular apertures, each of said bushing having a cylindrical central portion and terminating in spaced radially extending flanges, said radial ledge received between said flanges;

a connecting tube having opposite ends provided with oppositely facing stepped diameter frusto conical ridges, said connecting tube opposite ends frictionally engaged in said bushings, forming a sealed fluid connection;

fluid connection means for connecting said fluid passages with a water supply line; and fluid distribution means for distributing water to an area adjacent said fence.

2. The combined fence and irrigation system of claim 1, further comprising a spray nozzle having a connection stem provided with a plurality of stepped diameter frusto conical ridges, said nozzle connection stem engaged in one of said countersunk circular apertures.

3. The combined fence and irrigation system of claim 1, further comprising a screen including a plurality of grommets disposed to overlie selected ones of said countersunk circular apertures on said posts; and a plurality of mounting studs for securing said screen to said posts, said mounting studs dimensioned for engagement through said grommets and in said apertures.

4. The combined fence and irrigation system of claim 3, further comprising an ornamental cover mounted on each of said countersunk mounting studs to cover said countersunk circular apertures.

5. The combined fence and irrigation system of claim 4, wherein said ornamental covers are formed to simulate natural flowers.

6. The combined fence and irrigation system of claim 4, wherein said mounting stud comprises a connection end portion including a plurality of axially spaced stepped diameter frusto conical ridges;

an intermediate cylindrical stem;

a recess having an undercut frusto conical end portion;

a radial flange surrounding said recess;

a pin member having a cylindrical stem terminating in a frusto conical end portion dimensioned for engagement in said undercut recess;

an enlarged head at an opposite end of said pin member; and a circular bore formed through said cover and dimensioned to allow insertion of said pin member, whereby said cover may be captured between said radial flange and said enlarged head.

7. The combined fence and irrigation system of claim 1, wherein at least one of said posts includes an axial fluid passage opening through a pointed ground insertion end of said posts.

8. A combined fence and irrigation system, comprising:

a plurality of generally vertical spaced posts;

a plurality of generally horizontal rails connecting said posts;

a plurality of cross brace members extending generally diagonally between said posts and rails, said cross brace members formed to simulate natural vegetation branches;

fluid passages in said posts and said rails;

connecting means connecting said posts and rails with said fluid passages in fluid communication;

fluid connection means for connecting said fluid passages with a water supply line; and fluid distribution means for distributing water to an area adjacent said fence.

9. The combined fence and irrigation system of claim 8, wherein each of said posts and said rails are provided with countersunk circular apertures communicating with said fluid passages;

a radial ledge formed around each of said circular apertures;

a resilient bushing in each of said circular apertures, each of said bushings having a cylindrical central portion and terminating in spaced radially extending flanges, said radial ledge received between said flanges; and a connecting tube having opposite ends provided with oppositely facing stepped diameter frusto conical ridges, said connecting tube opposite ends frictionally engaged in said bushings, forming a sealed fluid connection.

10. The combined fence and irrigation system of claim 9, further comprising a spray nozzle having a connection stem provided with a plurality of stepped diameter frusto conical ridges, said nozzle connection stem engaged in one of said countersunk circular apertures.

11. The combined fence and irrigation system of claim 9, further comprising a screen including a plurality of grommets disposed to overlie selected ones of said countersunk circular apertures on said posts; and a plurality of mounting studs for securing said screen to said posts, said mounting studs dimensioned for engagement through said grommets and in said apertures.

12. The combined fence and irrigation system of claim 11, further comprising an ornamental cover mounted on each of said countersunk mounting studs to cover said countersunk circular apertures.

13. The combined fence and irrigation system of claim 12, wherein said mounting stud comprises a connection end portion including a plurality of axially spaced stepped diameter frusto conical ridges;

an intermediate cylindrical stem;

a recess having an undercut frusto conical end portion;

a radial flange surrounding said recess;

a pin member having a cylindrical stem terminating in a frusto conical end portion dimensioned for engagement in said undercut recess;

an enlarged head at an opposite end of said pin member; and a circular bore formed through said cover and dimensioned to allow insertion of said pin member, whereby said cover may be captured between said radial flange and said enlarged head.

14. The combined fence and irrigation system of claim 12, wherein said ornamental covers are formed to simulate natural flowers.

15. The combined fence and irrigation system of claim 8, wherein at least one of said posts includes an axial fluid passage opening through a pointed ground insertion end of said post.

* * * * *